US007111666B2

(12) United States Patent
Zeighami et al.

(10) Patent No.: US 7,111,666 B2
(45) Date of Patent: Sep. 26, 2006

(54) HEAT SINK

(75) Inventors: Roy M. Zeighami, McKinney, TX (US); Christian L Belady, McKinney, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/109,990

(22) Filed: Mar. 28, 2002

(65) Prior Publication Data

US 2003/0183371 A1 Oct. 2, 2003

(51) Int. Cl.
*F28D 15/00* (2006.01)

(52) U.S. Cl. ..... 165/80.3; 165/104.26; 165/185; 174/15.2

(58) Field of Classification Search ..... 165/80.3, 165/185, 104.33, 104.26; 361/700; 257/715, 257/714; 174/15.2, 16.3; 29/890.03, 890.049
See application file for complete search history.

(56) References Cited

U.S. PATENT DOCUMENTS

| | | | | |
|---|---|---|---|---|
| 3,766,977 | A * | 10/1973 | Pravda et al. | 165/80.3 |
| 4,154,296 | A * | 5/1979 | Fijas | 29/890.049 |
| 5,632,158 | A * | 5/1997 | Tajima | 165/104.33 |
| 5,947,192 | A * | 9/1999 | Kuo | 165/80.3 |
| 6,017,185 | A * | 1/2000 | Kuo | 415/177 |
| 6,227,288 | B1 * | 5/2001 | Gluck et al. | 165/104.26 |

FOREIGN PATENT DOCUMENTS

JP 4-79298 * 3/1992

* cited by examiner

*Primary Examiner*—Ljiljana Ciric
(74) *Attorney, Agent, or Firm*—Leslie P. Gehman

(57) ABSTRACT

A heat sink is constructed including at least one heat sink fin. Each fin includes an opening sized to fit a thermal device when the fins are heated to a temperature above that of the thermal device. When the fins cool to the temperature of the thermal device they shrink in size and form a tight compression fit around the thermal device.

3 Claims, 10 Drawing Sheets

HEAT SINK

FIELD OF THE INVENTION

The present invention is related generally to the field of heat transfer and more specifically to the field of thermal contact resistance during heat transfer.

BACKGROUND OF THE INVENTION

Modern electronics have benefited from the ability to fabricate devices on a smaller and smaller scale. As the ability to shrink devices has improved, so has their performance. Unfortunately, this improvement in performance is accompanied by an increase in power as well as power density in devices. In order to maintain the reliability of these devices, the industry must find new methods to remove this heat efficiently.

By definition, heat sinking means that one attaches a cooling device to a heat-generating component and thereby removes the heat to some cooling medium, such as air or water. Unfortunately, one of the major problems in joining two devices to transfer heat is that a thermal interface is created at the junction. This thermal interface is characterized by a thermal contact impedance. Thermal contact impedance is a function of contact pressure and the absence or presence of material filling small gaps or surface variations in the interface.

As the power density of electronic devices increases, heat transfer from the heat generating devices to the surrounding environment becomes more and more critical to the proper operation of the devices. Many current electronic devices incorporate heat sink fins to dissipate heat to the surrounding air moving over the fins and to increase the surface area of the device for radiant cooling. These heat sinks are thermally connected to the electronic devices by a variety of techniques. Some devices use a thermally conductive paste in an attempt to lower the contact resistance. Others may use solder between the two elements both for mechanical strength and thermal conductance. However, these two solutions require additional cost and process steps that would not be necessary except for presence of the contact resistance.

SUMMARY OF THE INVENTION

A heat sink is constructed including at least one heat sink fin. Each fin includes an opening sized to fit a thermal device when the fins are heated to a temperature above that of the thermal device. When the fins cool to the temperature of the thermal device they shrink in size and form a tight compression fit around the thermal device.

Other aspects and advantages of the present invention will become apparent from the following detailed description, taken in conjunction with the accompanying drawings, illustrating by way of example the principles of the invention.

DETAILED DESCRIPTION

Figure 1:
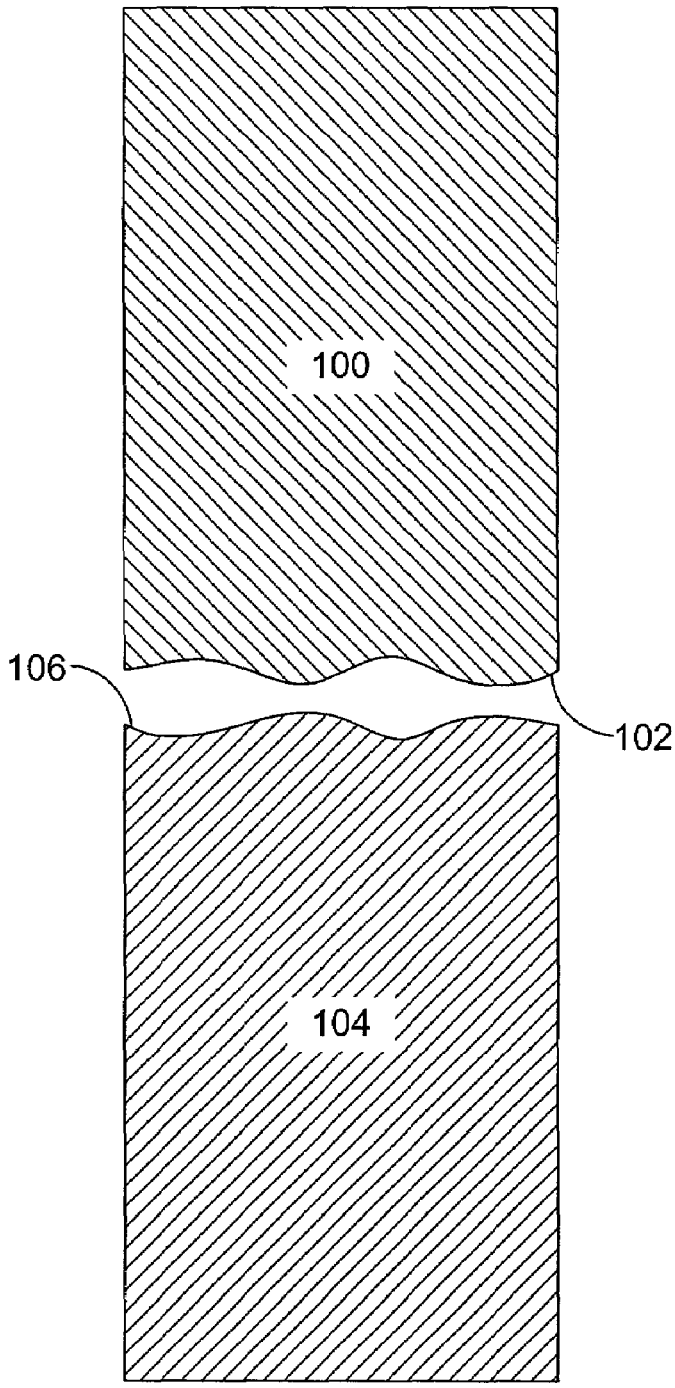
FIG. 1 PRIOR ART
FIG. 1 is a cross-section of the interface between two surfaces.

FIG. 1 is a cross-section of the interface between two surfaces. In this greatly magnified view of the interface between two surfaces, a first object 100 having a first surface 102 is brought into contact with a second object 104 having a second surface 106. Neither surface is perfectly flat resulting in an imperfect mating of the two surfaces. This imperfect interface contributes to a thermal contact resistance at the interface between the two objects.

Figure 2:
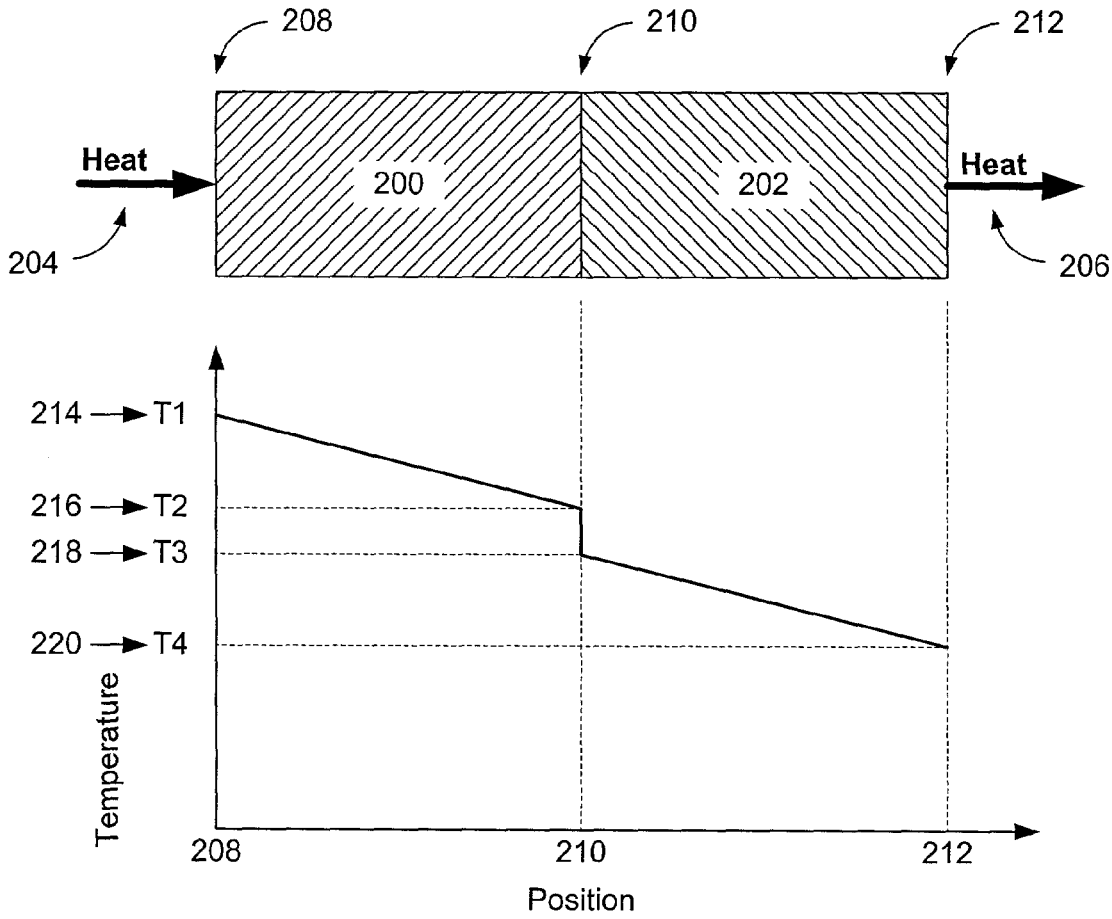
FIG. 2 PRIOR ART
FIG. 2 is a graph of temperature versus position through an interface between two thermal conductors.

FIG. 2 is a graph of temperature versus position through an interface between two thermal conductors. In this view of two thermally conductive objects joined together, a graph of temperature versus position is shown below a cross-sectional view of the two objects including the thermal interface 210 between them. A first object 200 is joined with a second object 202 producing a thermal interface 210 at the point where the objects join. As shown in FIG. 1, this interface between the two objects is not a perfect joint and contributes to a thermal contact resistance at the thermal interface 210. When thermal energy as heat 204 enters the first object 200, passes through it to the second object 202, before exiting the second object as heat 206, the thermal energy must pass through the thermal interface 210 between the two objects. The thermal energy enters the first object 200 at a position 208 and a temperature T1 214, and decreases to a temperature T2 216 as it passes through the first object 200. At the thermal interface 210 between the two objects the thermal energy must overcome a thermal contact resistance and the temperature decreases to a temperature T3 218 as it enters the second object 202. The temperature decreases to a temperature T4 220 as it passes through the second object 202 where it is radiated as heat 206 at a position 212.

Figure 3:
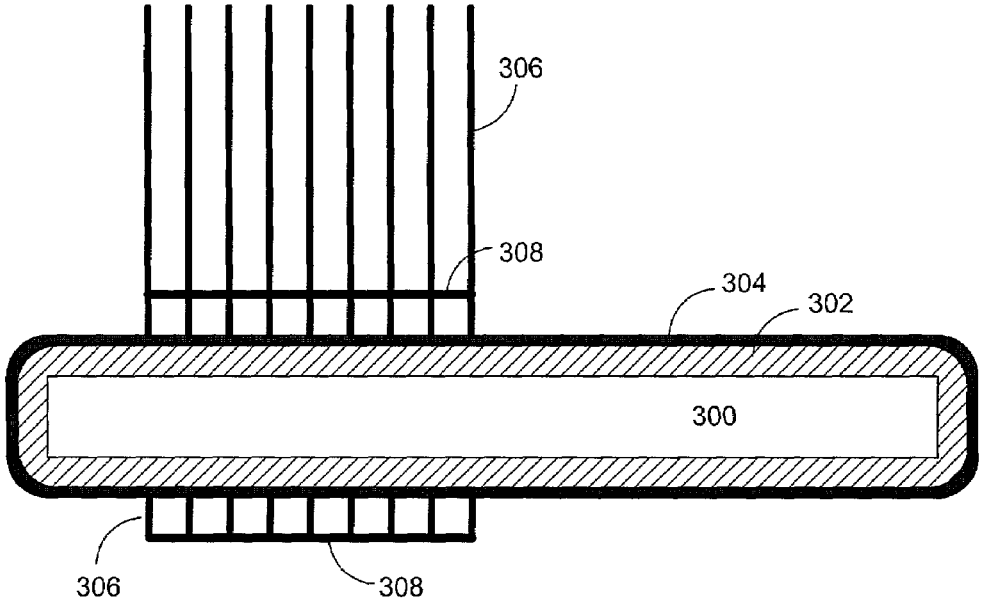
FIG. 3 is a cross-section of a heat sink affixed to a heat pipe or other thermal device according to an example embodiment of the present invention.

FIG. 3 is a cross-section of a heat sink affixed to a heat pipe or other thermal device according to an example embodiment of the present invention. In this example embodiment of the present invention, a plurality of heat sink fins 306 are shown attached to a heat pipe 304. Other thermal devices, such as cold plates, may be used within the scope of the present invention. Also, some embodiments of the present invention may directly attach the heat sink fins to the device generating the heat that requires dissipation without the use of a heat pipe or cold plate. The plurality of heat sink fins 306 are attached together by two brackets 308 that keep the fins 306 spaced apart to allow air to flow between the plurality of heat sink fins 306. The heat pipe 304 comprises a vapor 300 surrounded by a wick 302 within the vessel of the heat pipe. Where the heat pipe 304 is thermally connected with a heat producing device, the liquid within the wick 302 evaporates to form a vapor 300. This heated vapor 300 moves within the heat pipe 304 to the cooler area within the heat sink fins 306 where the vapor 300 condenses on the wick 302 into a liquid. This liquid then flows back through the wick 302 to the portion of the heat pipe 304 connected with a heat producing device where the process continues.

Figure 4:
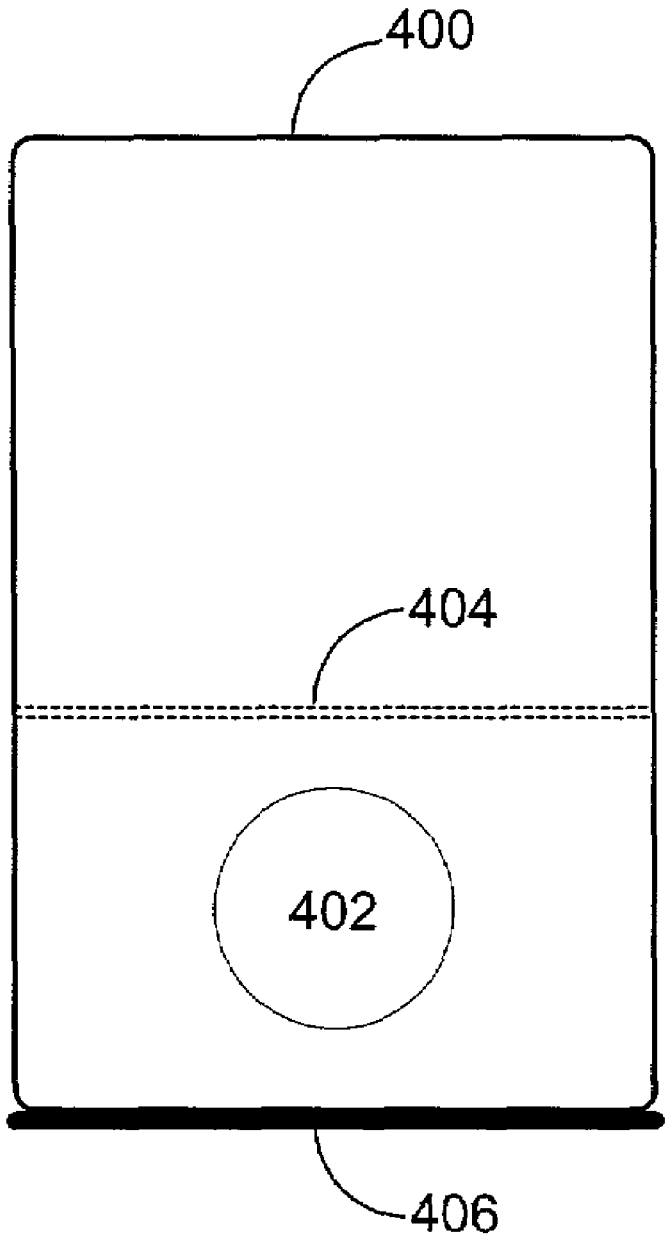
FIG. 4 is a front view of a heat sink for attachment to a heat pipe or other thermal device according to an example embodiment of the present invention.

FIG. 4 is a front view of a heat sink for attachment to a heat pipe or other thermal device according to an example embodiment of the present invention. Similar to the example embodiment of the present invention shown in FIG. 3, here at least one heat sink fin 400 includes an opening 402. This opening is configured such that when the heat sink fin 400 is heated to a high temperature, thermal expansion of the heat sink fin 400 causes the opening 402 to grow such that a thermal device will fit into the opening 402. As the heat sink fin 400 cools, the opening 402 shrinks in size forming a tight compression fit with the thermal device. The resulting high contact pressure dramatically lowers the thermal contact resistance of this thermal interface between the heat sink and the thermal device. In this example embodiment of the present invention a top spacer 404 and a bottom spacer 406 are shown holding the heat sink fins 400 in place. Example spacers are also shown in FIG. 5.

Figure 5:
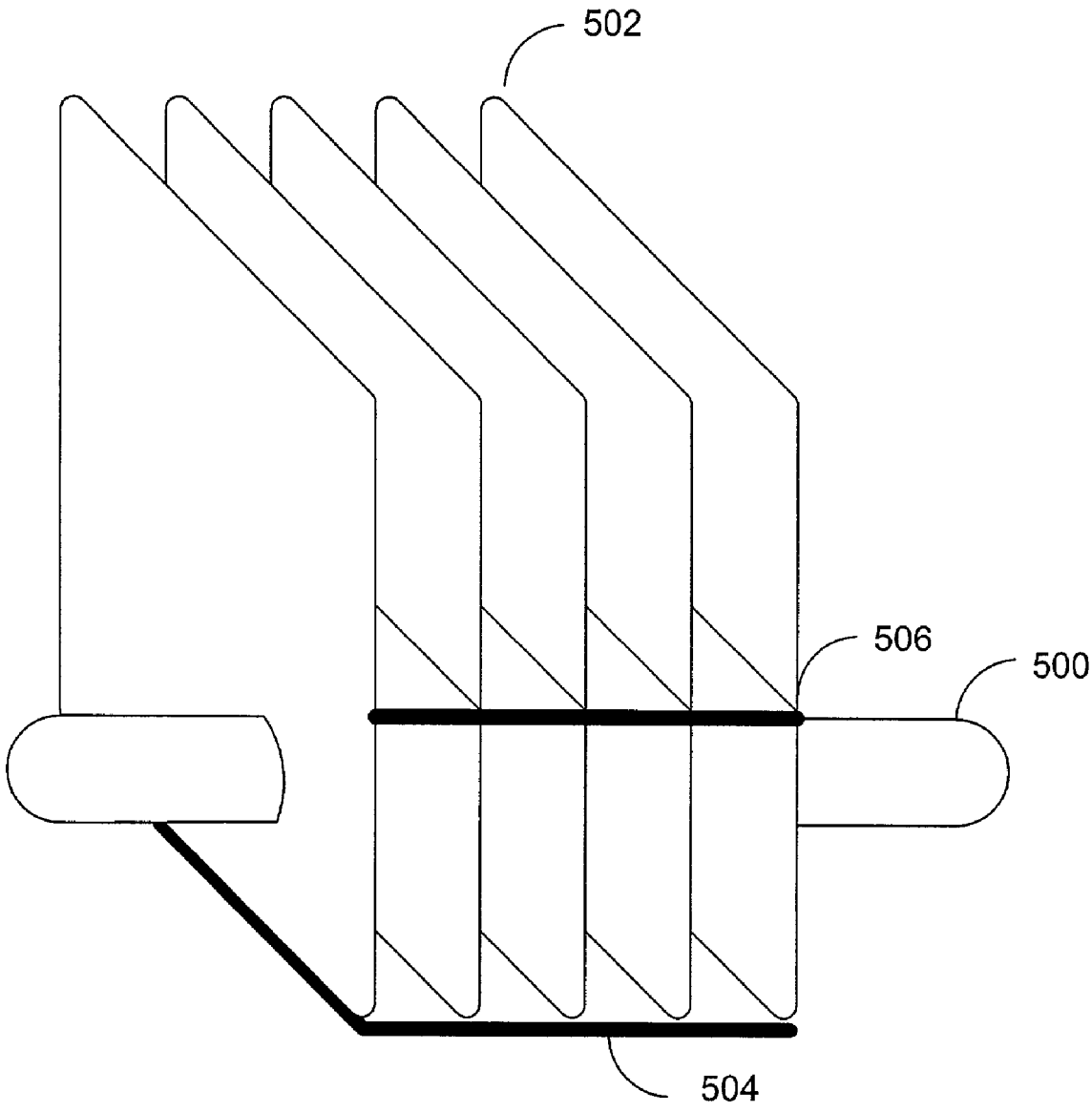
FIG. 5 is a perspective view of a heat sink affixed to a heat pipe or other thermal device according to an example embodiment of the present invention.

FIG. 5 is a perspective view of a heat sink affixed to a heat pipe or other thermal device according to an example embodiment of the present invention. The example embodiment of the present invention shown in FIG. 5 is similar to that of FIGS. 3 and 4. A plurality of heat sink fins 502 are aligned by a top spacer 506 and a bottom spacer 504 and are compression fit on a heat pipe 500. Note that in other embodiments of the present invention, the number of heat sink fins 502 may vary from one fin up to any number of fins. In other embodiments of the present invention these spacers may not be necessary since the fins 502 may be added individually, aligned with the thermal device and cooled before the next fin 502 is added. Thus the compression fit of the fins 502 to the thermal device may be used to keep the fins 502 in a desired configuration.

A heat sink comprising a single fin most likely will not require spacers, but may include other attachments for alignment with the heat pipe or thermal device.

Figure 6A:
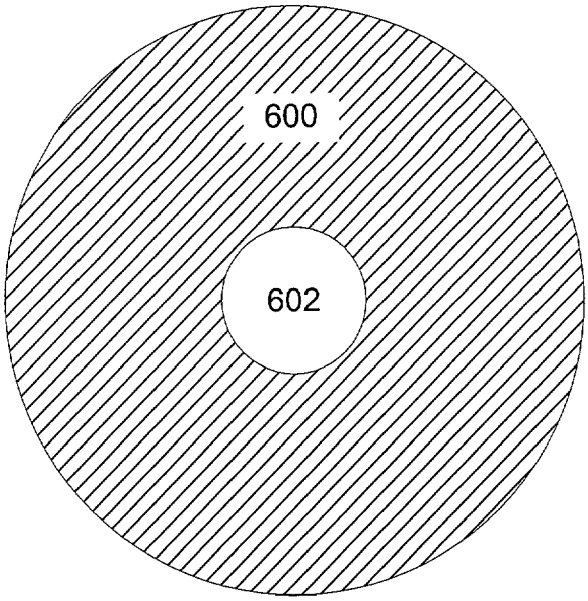
FIGS. 6A and 6B are front views of fins configured for attachment to a heat pipe or other thermal device according to an example embodiment of the present invention.
Figure 6B:
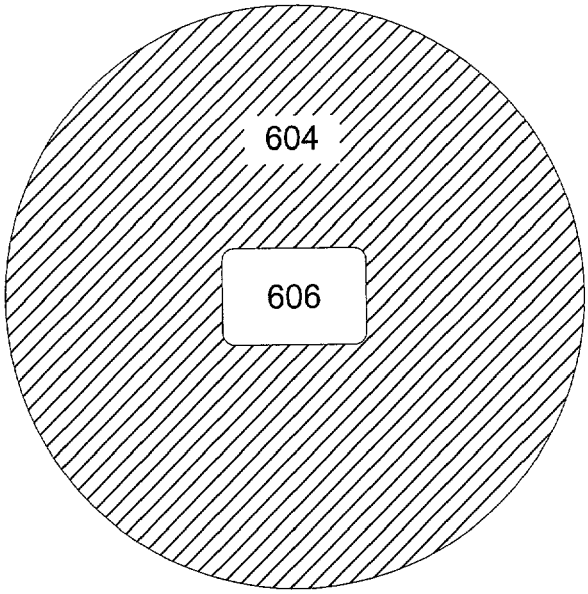

FIGS. 6A and 6B are front views of fins configured for attachment to a heat pipe or other thermal device according to an example embodiment of the present invention. The example embodiment of the present invention shown in FIG. 6A is a circular fin 600 including a circular opening 602. The example embodiment of the present invention shown in FIG. 6B is a circular fin 604 including a generally rectangular opening 606. These are simply two examples of the many possible configurations of heat sink fins and openings within the scope of the present invention. The fins and openings may be any shape desired, as long as the opening is configured to fit over a thermal device when the fin is heated.

Figure 7:
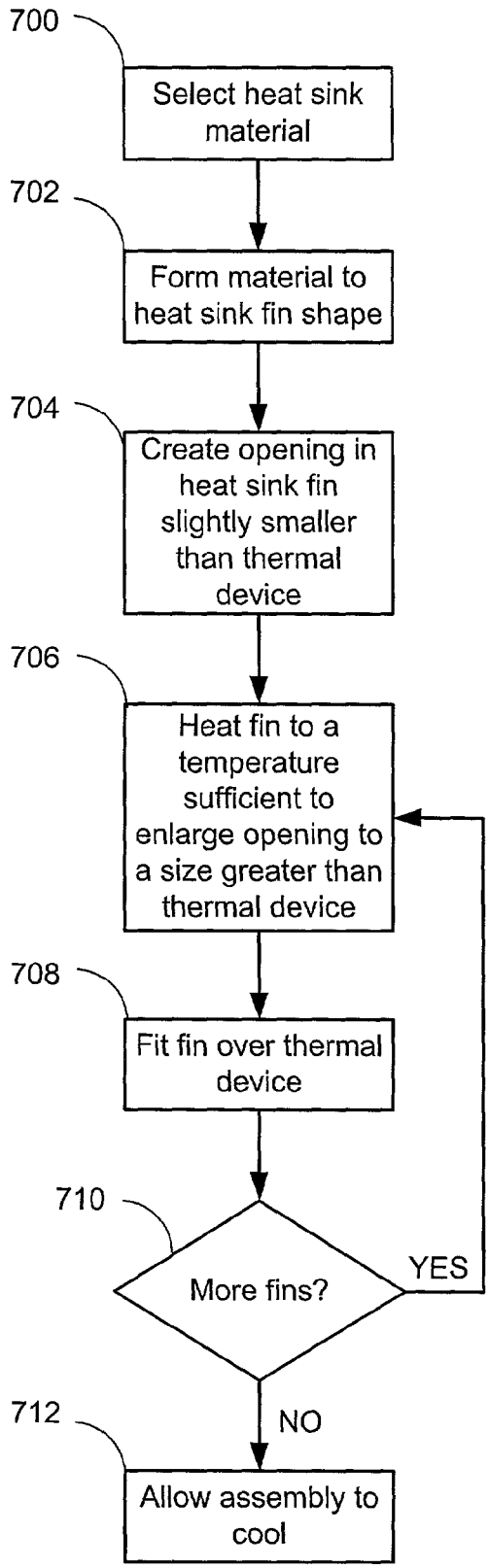
FIG. 7 is a flow chart of a method of shrink fitting a heat sink or heat sink fin to a heat pipe or other thermal device according to an example embodiment of the present invention.
Figure 8:
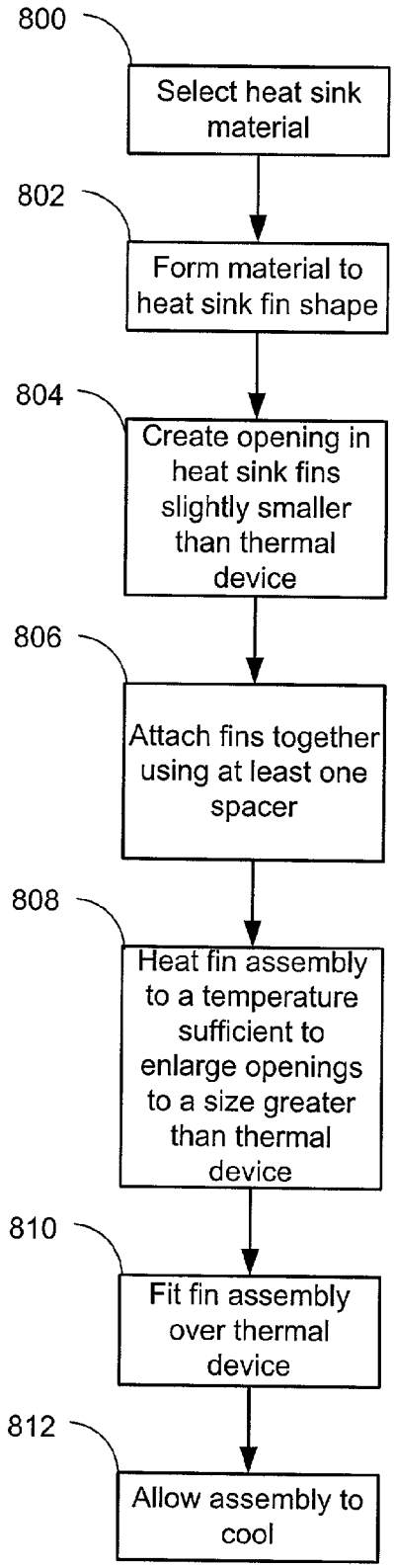
FIG. 8 is a flow chart of a method of shrink fitting a heat sink or heat sink fin to a heat pipe or other thermal device according to an example embodiment of the present invention.

FIG. 7 is a flow chart of a method of shrink fitting a heat sink or heat sink fin to a heat pipe or other thermal device according to an example embodiment of the present invention. The example method of shrink fitting at least one heat sink fin to a thermal device shown in FIG. 7 is but one example method within the scope of the present invention. The method shown in FIG. 7 does not include the step of attaching spacers to the heat sink fins, since this step, like many other of the method steps, is not necessary in all embodiments of the present invention. A method of shrink fitting a heat sink or heat sink fin to a thermal device including the step of attaching spacers to the heat sink fins is shown in FIG. 8. The method steps shown in FIG. 7 may be applied in a different order than that of FIG. 7 within the scope of the present invention. In a step 700, suitable material for the heat sink fins is selected. This material may vary within the scope of the present invention, and example materials include aluminum and copper. In a step 702 the material chosen for the heat sink fins is cut, punched, or otherwise formed into the desired shape of a heat sink fin. This fin shape may vary widely within the scope of the present invention. In a step 704 an opening slightly smaller than a heat sink or other thermal device is cut, punched, or otherwise formed in the heat sink fin. This opening may be any shape desired within the scope of the present invention. The size of the opening is determined by calculating how hot the fin will be heated to, ensuring that the opening will grow to a size allowing the heat pipe or other thermal device to fit within the opening when the fin is heated to the higher temperature. Further, the opening must be sized such that upon cooling, the fin does not contract around the heat pipe or other thermal device in an amount sufficient to damage the heat pipe or other thermal device. In a step 706 the heat sink fin is heated to a temperature higher than that of the heat pipe or other thermal device, sufficient to allow the fin to fit over the heat pipe or other thermal device. The temperature required to expand the opening an amount sufficient to fit over the heat pipe will be higher than any normal operating temperatures of the assembled system, otherwise the compression fit of the fins to the thermal device will be reduced or eliminated at high operating temperatures. In a step 708 the heated heat sink fin is fit over the heat pipe or other thermal device. In a decision step 710 if more fins are to be attached to the heat pipe or other thermal device, control is passed to step 706 and the remaining fins are heated for attachment. If no further fins are to be attached, in a step 712 the completed assembly is allowed to cool.

FIG. 8 is a flow chart of a method of shrink fitting a heat sink or heat sink fin to a heat pipe or other thermal device according to an example embodiment of the present invention. The example method of shrink fitting at least one heat sink fin to a thermal device shown in FIG. 8 is but one example method within the scope of the present invention. The method steps shown in FIG. 8 may be applied in a different order than that of FIG. 8 within the scope of the present invention. In a step 800, suitable material for the heat sink fins is selected. This material may vary within the scope of the present invention, and example materials include aluminum and copper. In a step 802 the material chosen for the heat sink fins is cut, punched, or otherwise formed into the desired shape of a heat sink fin. This fin shape may vary widely within the scope of the present invention. In a step 804 an opening slightly smaller than a heat sink or other thermal device is cut, punched, or otherwise formed in the heat sink fin. In a step 806 the heat sink fins are attached together with at least one spacer in a configuration allowing air to flow between the heat sink fins. The openings in the heat sink fins align to allow the heat pipe or other thermal device to be inserted in the openings, forming a heat sink assembly. In a step 808 the resulting heat sink assembly is heated to a temperature sufficient to enlarge the openings in the heat sink fins to a size greater than that of the heat pipe or other thermal device. In a step 810 the hot heat sink assembly is placed over the heat pipe or other thermal device, and in a step 812, the entire assembly is allowed to cool.

Figure 9:
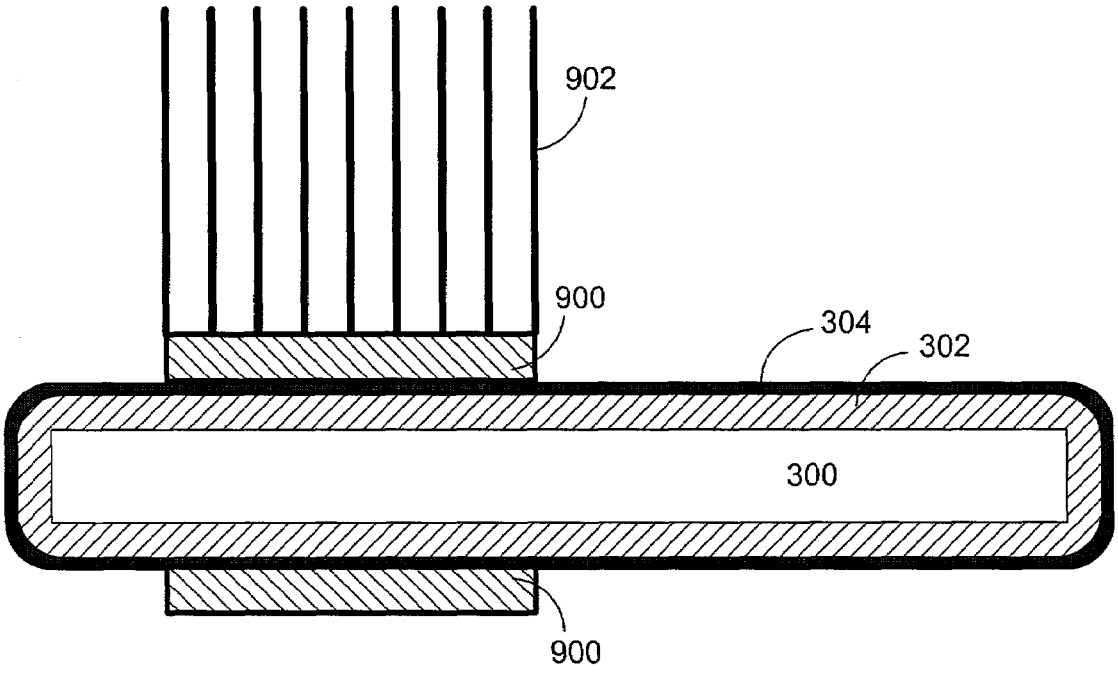
FIG. 9 is a cross-section of a heat sink affixed to a heat pipe or other thermal device according to an example embodiment of the present invention.

FIG. 9 is a cross-section of a heat sink affixed to a heat pipe or other thermal device according to an example embodiment of the present invention. This example embodiment of the present invention is similar to that shown in FIG. 3, with the exception of the opening being located in the heat sink body itself instead of each of the individual heat sink fins. A heat sink body 900 is constructed from any desired heat sink material with an opening slightly smaller than the heat pipe or other thermal device to be cooled. Attached to the heat sink body 900 is at least one fin 902. The fins 902 and heat sink body 900 may be constructed in any shape desired for cooling the thermal device. The example embodiment of the present invention shown in FIG. 9 has fins 902 on one side of the heat sink body 900. However, those skilled in the art will recognize that the fins 902 may be placed virtually anywhere on the heat sink body 900, including surrounding the entire heat sink body 900.

Figure 10:
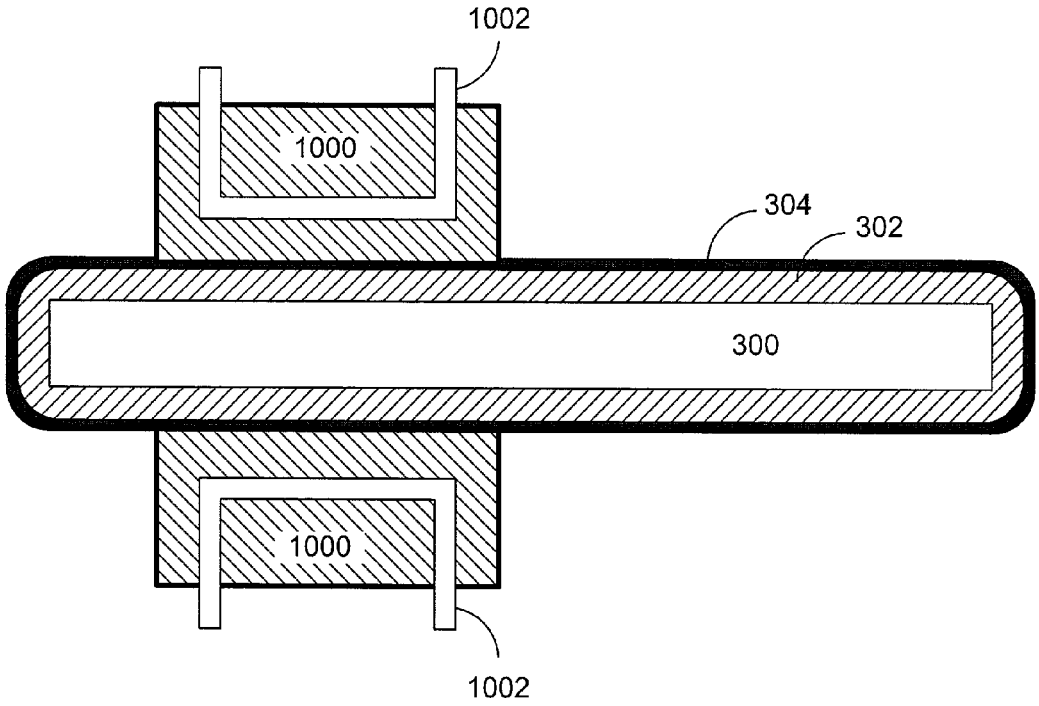
FIG. 10 is a cross-section of a heat sink affixed to a heat pipe or other thermal device according to an example embodiment of the present invention.

FIG. 10 is a cross-section of a heat sink affixed to a heat pipe or other thermal device according to an example embodiment of the present invention. The heat sink shown in FIG. 10 is similar to that of FIG. 9 with the exception that the heat sink fins from FIG. 9 have been replaced with channels configured for liquid cooling. A heat sink body 1000 is shown in cross section including two channels configured for liquid cooling 1002. Note that any number of liquid cooling channels may be formed in the heat sink body within the scope of the present invention. Also, while FIG. 10 shows a thermal device consisting of a heat pipe, as shown in previous figures, any other thermal device may be cooled with a heat sink including liquid cooling channels designed according to the present invention. For example, the thermal device may also include liquid channels and when the heat sink including liquid cooling channels is attached to the thermal device according to the present invention, a liquid-to-liquid heat exchanger results.

The foregoing description of the present invention has been presented for purposes of illustration and description. It is not intended to be exhaustive or to limit the invention to the precise form disclosed, and other modifications and variations may be possible in light of the above teachings. The embodiments were chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A heat sink assembly comprising:

a heat pipe at least one heat sink fin including an opening;

wherein said opening has a first area when said at least one heat sink fin is at a first temperature, and has a second area when said at least one heat sink fin is at a second temperature, wherein said first area is smaller than said second area when said first temperature is lower than said second temperature; and wherein said opening is configured such that said first area is slightly smaller than a cross-section of said heat pipe when said heat pipe is at said first temperature and said second area is larger than a cross-section of said heat pipe when said heat pipe is at said first temperature; and wherein said at least on heat sink fin forms a compression fit with said heat pipe when said heat sink fin is cooled to said first temperature, after said heat pipe has been inserted into said opening while said heat sink fin was at said second temperature.

2. The heat sink assembly recited in claim 1, further comprising:

at least one spacer mechanically attached to said at least one heat sink fin;

wherein said at least one spacer is configured to allow air to flow between said at least one heat sink fin.

3. The heat sink assembly recited in claim 1, wherein said at least one heat sink fin is aluminium.

* * * * *

UNITED STATES PATENT AND TRADEMARK OFFICE

CERTIFICATE OF CORRECTION

PATENT NO. : 7,111,666 B2
APPLICATION NO. : 10/109990
DATED : September 26, 2006
INVENTOR(S) : Roy M. Zeighami et al.

It is certified that error appears in the above-identified patent and that said Letters Patent is hereby corrected as shown below:

In column 6, line 39, in Claim 3, delete “aluminium” and insert -- aluminum --, therefor.

Signed and Sealed this

Thirtieth Day of December, 2008

JON W. DUDAS
*Director of the United States Patent and Trademark Office*